United States Patent [19]

Greiner et al.

[11] 4,455,552

[45] Jun. 19, 1984

[54] COMBINATION LOCKS WITH ELECTRO-OPTICAL SILENT ALARM SYSTEM

[75] Inventors: Garry C. Greiner, Lexington; Joe A. Shelley, Jr., Paris, both of Ky.

[73] Assignee: Sargent & Greenleaf, Inc., Nicholasville, Ky.

[21] Appl. No.: 324,821

[22] Filed: Nov. 24, 1981

[51] Int. Cl.[3] ..... E05B 45/06

[52] U.S. Cl. ..... 340/543; 70/333 R; 70/DIG. 49; 340/671

[58] Field of Search ..... 340/542, 543, 671; 70/333 R, 432, 439, DIG. 49

[56] References Cited

U.S. PATENT DOCUMENTS

| | | | |
|---|---|---|---|
| 2,923,928 | 2/1960 | McLaughlin | 340/543 |
| 3,056,125 | 9/1962 | Harry | 340/543 X |
| 3,171,115 | 2/1965 | Calabro | 340/543 |
| 3,623,059 | 11/1971 | Rickerd | 340/671 X |
| 4,090,181 | 5/1978 | Ansari et al. | 340/671 |
| 4,107,655 | 8/1978 | Moorhouse | 340/543 X |
| 4,185,279 | 1/1980 | Bachman | 340/671 |

*Primary Examiner*—David L. Trafton

*Attorney, Agent, or Firm*—Mason, Fenwick & Lawrence

[57] ABSTRACT

A combination lock of the dial operated tumbler wheel type comprising lock mechanism components including a fence lever and rotatable members to be rotatably positioned responsive to rotation of a dial, the rotatable members including peripherally gated tumbler wheels and a drive cam driven from the dial, and electro-optical light sensing and electrical signalling means for producing sensible indications at a remote monitoring station signifying movement of components of the combination lock mechanism. This means comprises a marking having optically distinctive reflectivity properties on a component of the lock mechanism such as the driving cam and/or a tumbler wheel and/or the fence lever and optical sensor means positioned to receive light from the optically distinctive marking electrical signal signifying movement of the optically distinctive marking.

6 Claims, 7 Drawing Figures

Fig-1
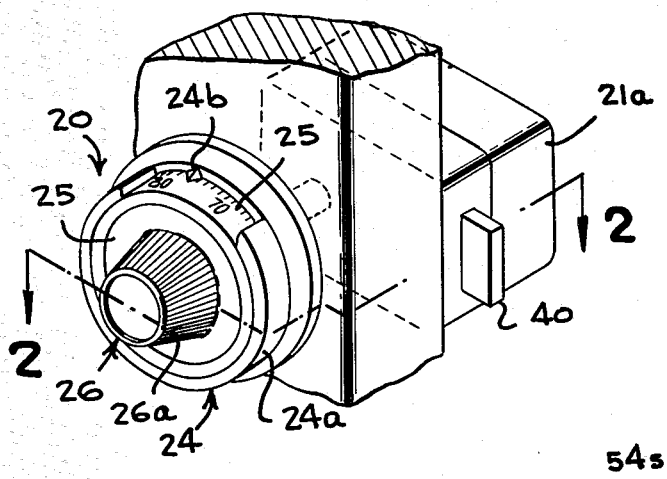
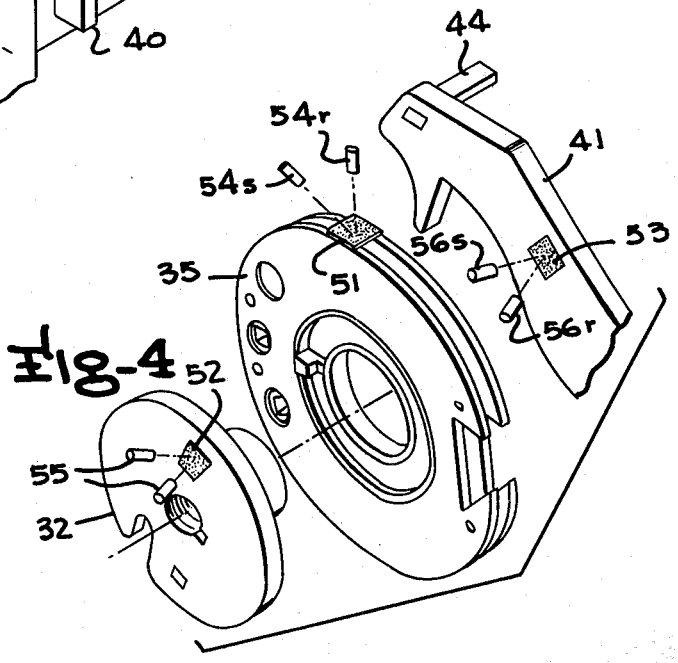
Fig-4
Fig-5A
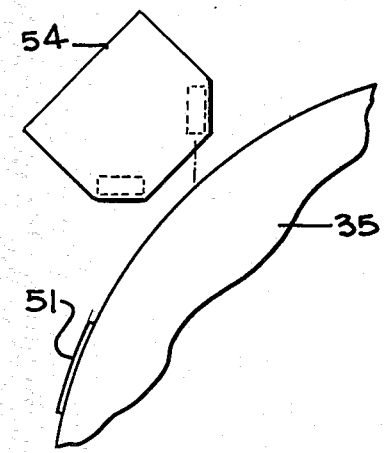
Fig-5B
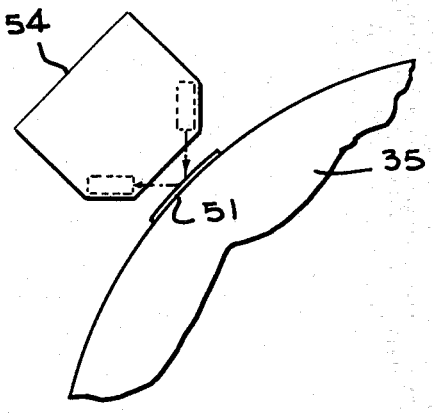

COMBINATION LOCKS WITH ELECTRO-OPTICAL SILENT ALARM SYSTEM

BACKGROUND AND OBJECTS OF THE INVENTION

The present invention relates in general to combination locks of the tumbler wheel type, and more particularly to tumbler wheel type combination lock monitoring systems for monitoring the condition of combination locks and producing an alarm signal at a remote location when the monitored combination lock is being manipulated or operated in an unauthorized opening attempt.

Conventional locks of the class known as combination locks usually comprise three or four tumbler wheels which are loosely journaled in a coaxial, side-by-side spaced stack for rotation whith a lock casing on a tubular arbor or tumbler post projecting inwardly from the front wall of the casing or from the rear cover plate. The lock dial, which usually has 100 peripheral calibration marks thereon, is affixed to a dial spindle which extends through the bore of the tumbler post and has keyed to the inner end thereof a disc-like drive cam which is likewise arranged coaxially with and spaced rearwardly from the stack of tumbler wheels. A drive pin projects forwardly from the drive cam and with a conventional fly rotatable through a limited arc and associated with the rearmost tumbler wheel, provides a lost motion coupling to drive the tumbler wheel in selected relation to the drive cam. A similar lost motion coupling is provided between each of the tumbler wheels so that they may be driven upon predetermined rotation of the drive cam. A thin spacer washer is also customarily provided between each of the tumbler wheels. Each of the flies or fly members between the successive tumbler wheels and between the rearmost tumbler wheel and the drive cam typically comprise a ring portion journaled in concentric relation with the associated tumbler wheel and a radial projection which lies between a pair of stop shoulders disposed to abut portions of the radial projection and limit angular rotation of the fly to about 20° or other desired limited angular range. A drive pin or lug projects from the adjacent tumbler wheel into position to abut the radial projection of the fly and transmit rotation to the adjacent tumbler wheel after the fly has moved through its predetermined lost motion angular range. Each of the tumber wheels and the drive cam are provided with a peripheral notch or gate at a selected radial position on the drive cam and tumblers.

A fence lever which is pivotally connected near one end on a reciprocative bolt member slidably supported in the lock casing is provided with a depending nose near the opposite or free end of the fence lever which is designed to ride upon the drive cam periphery, in conventional combination locks, and has a bar or fence projecting laterally from the fence lever in overlying relation to the peripheries of the tumbler wheels. The position of the fence in relation to the length of the fence lever nose is usually such that the fence is spaced slightly outwardly from the peripheries of the tumbler wheels when the fence lever nose is riding on the drive cam periphery.

The combination lock is opened, in the case of such conventional combination lock structures, by rotation of the dial in a predetermined sequence in clockwise and counterclockwise directions through predetermined numbers of revolutions to a series of numerical positions indicated by alignment of numbers or indicia on the lock dial with a fixed index adjacent the lock dial periphery, to dial a predetermined series of combination numbers and thereby effect angular rotation of the plurality of tumbler wheels to positions which result in alignment of the tumbler wheel peripheral gates with the fence. The dial is then rotated to bring the drive cam gate to a position registered with the fence lever nose to cause the fence lever nose and fence to drop into the gates whereupon further rotation of the dial through a partial revolution in a predetermined direction achieves retraction of the bolt.

Also, combination locks have been provided with various types of guard or shielding mechanisms mounted on the drive cam to resist detection of the combination by the "feel" of the points of engagement of the fence lever nose with the driving cam gate in accordance with well-known lock manipulation procedures to resist opening of the lock by unauthorized persons who do not have authorized knowledge of the combination to which the lock has been set. Descriptions of such locks designed to defeat unauthorized detection of the lock combination are found in prior U.S. Pat. Nos. 2,575,674 and 2,807,954 as typical examples.

In especially sensitive high security locations designed to be protected by such tumbler wheel type combination locks, it is frequently desirable to be able to continuously monitor the condition of the combination lock protecting a security area or security container and provide a signal at a remote location or security monitoring station when a combination lock is undergoing attempted opening manipulation or operation at times when such lock operation is not authorized. Heretofore, various combination lock and push button lock systems have been proposed involving electrical switch arrangements associated within them to detect operation of the lock and provide a signal at a remote monitoring location indicating lock operation. Examples of these are found in U.S. Pat. Nos. 1,711,780 to Findlay, 2,855,588 to Allen, 1,871,303 to Chesick, and 726,254 to Carlton. Also, photocell light sensor systems assocatied with a rotary cylinder type key lock have been proposed in U.S. Pat. Nos. 3,889,501 to Fort, 3,749,930 and 3,845,362 to Roe, and 3,764,859 to Wood. However, none of these meet the requirements desired for a tumbler wheel type combination lock wherein components of the tumber wheel type combination lock are continuously monitored during a security period to detect movement of various components of the combination lock indicating attempted opening manipulation of the lock, which can provide reliable signals at remote monitoring stations to advise monitoring personnel of an authorizied operation of the lock.

An object of the present invention, therefore, is the provision of a novel tumbler wheel type combination lock system having light sensing means for monitoring the position of a plurality of components or portions of the combination lock and producing an alarm signal at a remote location when movement of the monitored combination lock components or portions occurs.

Another object of present invention is the provision of a novel and highly reliable light sensing and electrical signalling system in conjunction with tumbler wheel type combination locks for monitoring the position of various components of the lock and generating alarm signals at remote locations signifying unauthorized attempted operation of the lock.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a perspective view of a combination lock and light sensing and signalling monitoring system embodying the present invention;

FIG. 4 is a fragmentary perspective view showing a portion the rearmost tumbler wheel, driving cam and the fence lever with their optically-distinctive sensing areas and associated light source/phototransistor sensor units, in somewhat diagrammatic form, illustrating principles of the present invention;

FIGS. 5A and 5B are fragmentary diagrammatic views showing the optical light sensor and adjacent portions of the rearmost tumbler wheel in normal positions and alarm signal producing positions, respectively.

DETAILED DESCRIPTION OF A PREFERRED EMBODIMENT

Figure 2:
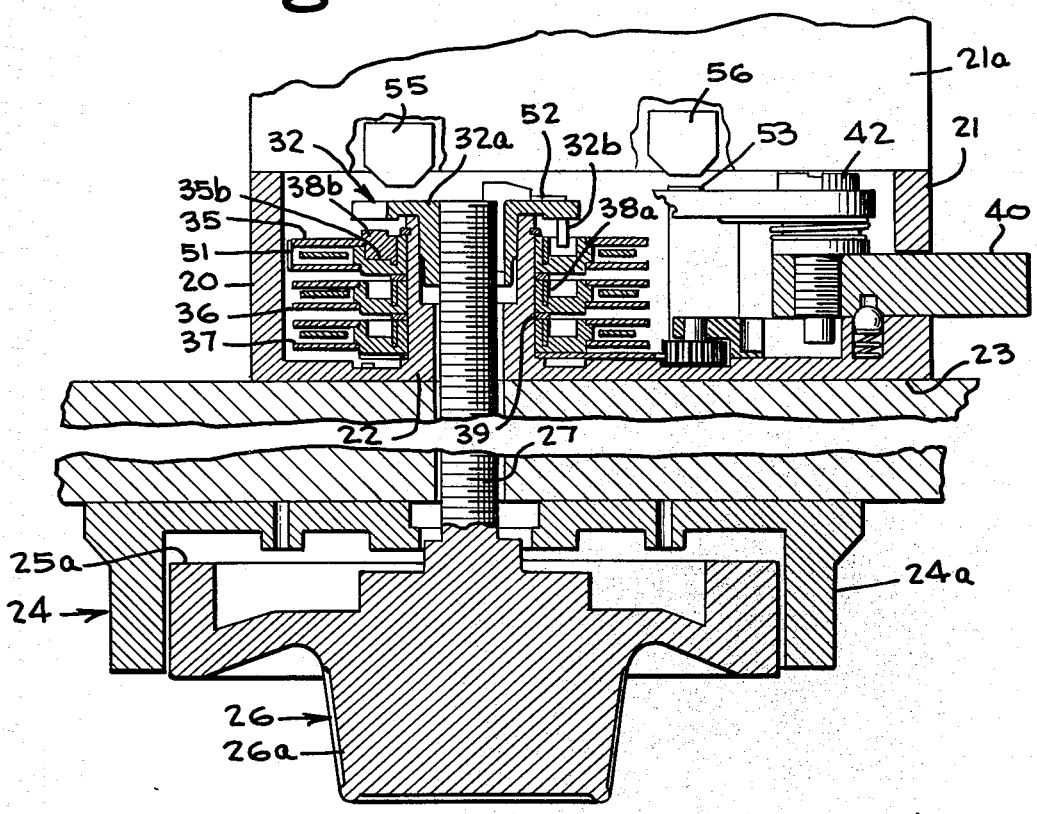
FIG. 2 is a horizontal section view of a combination lock taken along the line 2—2 of FIG. 1.

Referring to the drawings, wherein like reference characters designate corresponding parts throughout the several figures, there is illustrated a combination lock generally indicated by the reference character, 20, which is of the general type disclosed in the prior U.S. Pat. Nos. 2,275,674 and 2,807,954 issued to Harry C. Miller, or 3,968,667 issued to Klaus W. Gartner, all assigned to Sargent and Greenleaf, Inc., but which may optionally employ a normal drive cam as illustrated herein without special compromise-resisting features, rather than providing drive cams having guard mechanisms as disclosed in those earlier patents. The combination lock comprises a substantially rectangular lock case 21 having top and bottom walls **21*a*, 21*b* and a hollow boss or tumbler post 22 projecting rearwardly from the front wall 23 thereof. A removable rear cover plate 21*c* is provided to close the rear of the lock case 21. The lock case 21 is designed to be mounted against the inner surface of a door or other closure in the conventional manner, as by mounting screws extending through screw holes near the corners of the lock case and into the supporting door. Secured to the outer face of the supporting door concentric with the axis of the tumbler posts 22 is a dial ring 24, here shown as having a cylindrical shield 24*a* surrounding and shielding from view the major portion of the peripheral flange 25*a* of the dial portion 25 of the dial knob members 26, the shield 24*a* being interrupted by a sight opening 24*b*** of suitable circumferential extent.

The dial and knob member 26 is supported for rotation within the forwardly opening cylindrical well of the dial ring 24 defined by the shield **24*a*, and includes a drive spindle 27 coupled at its outermost end to the dial and knob member 26 and extending through the hollow tubular post 22 on the front wall of the lock case 21 to be rotatably journaled by the tumbler post and supported at the desired position. The dial and knob member 26 has a integral knob portion 26*a* thereon which projects forwardly from the dial portion 25 and preferably has a knurled periphery to facilitate manipulation of the dial and knob member 26**.

The spindle 27 in the preferred embodiment may be assembled to the dial and knob member 26 by a coupling mechanism similar to that disclosed in prior U.S. Pat. No. 2,951,358 granted to Harry C. Miller, wherein the forward end portion of the spindle 27 is provided with a knurled cylindrical region which is driven into a central bore extending axially through a coupling bushing forming a serrated head adapted to interfit in a rearwardly facing serrated cylindrical well in the dial and knob member 26, the coupling bushing being provided with a constricted neck portion of sufficient length to accommodate the knurled end portion of the spindle 27 and having an enlarged diameter annular body portion providing an uninterrupted series of teeth to be interfitted with similar teeth along the cylindrical surface of the well so that the spindle may be assembled with the dial and knob member at various angular positions. Alternatively, the spindle may simply be a rod having a threaded exterior and a kerf extending along most of its length from the rearmost end thereof, with the forwardmost end fixed in the dial and knob member 26 in any desired manner.

The threaded rearmost end of the drive spindle 27 receives an internally threaded portion of a tubular boss formation **32*a* projecting forwardly integrally from the driving cam 32. The driving cam 32 is keyed to the drive spindle 27 at the desired angular position by inserting a suitable spline key 33 into a radial groove in the center bore of the drive cam which is aligned radially with the longitudinal spline and with the kerf in the spindle 27** to interlock these components against further relative rotation.

A stack or array of a plurality of tumbler wheels, for example a three wheel stack indicated by the reference characters 35, 36 and 37, are supported to rotate freely upon the portion of the hollow boss or tumbler post 22 projecting rearwardly from the front wall of the lock case 21. It will be appreciated, of course, that a four tumbler wheel stack, or a stack of any other number of tumbler wheels may be used and that the tumbler post may be carried by the rear wall or cover plate instead of the front wall, as is well known. Each of the tumbler wheels 35, 36 and 37 are of conventional type designed to be changed by means of a conventional resetting key to vary the combination of the lock, and to this end comprise an inner hub on each of which are supported a pair of annular discs having a tumbler gate or peripheral recess, such as the recess **35*a*, therein. The outer annular discs are selectively locked against rotation relative to their supporting hubs by means of conventional locking arms or levers carried by and between the pair of annular discs on each hub and engaging peripheral serrations or teeth on the hub to hold the annular discs at a selected angular position. Conventional flies 8, consisting of annular rings 38*a* having an outwardly extending radial projection 38*b* thereon are provided between the pairs of tumblers 37-36, 36-35, and between tumbler 35 and drive cam 32, and an annular spacer washer 39, for example having an inner diameter conforming to the outer diameter of the tubular post 22 and having a pair of inwardly projecting lugs extending into grooves on the post to prevent its rotation, is provided between each tumbler wheel pair. In the illustrated embodiment, the ring portion 38***a* of each fly may be disposed in a rearwardly facing annular groove, such as groove 35*b*, journaled on the cylindrical surface defining the radially innermost wall of the groove, with the radial projection 38*b* also lying in the groove 35*b* and being of sufficient thickness to project rearwardly into the path of the forwardly projecting drive pin 32*b* on the drive cam. The outermost cylindrical wall of the groove 35*b* is interrupted by a radially outwardly extending cut providing a well of about 20 degrees circumferentially defining stop shoulders flanking the space occupied by the radial lug 38*b* in the path of the radial lug to limit the rotation of the fly to about 20 degrees. This provides the lost motion coupling between the drive cam 32 and the rearmost tumbler 35. The flies associated with the other tumbler wheels 36 and 37 are similarly constructed and disposed in rearwardly facing grooves in those tumblers to provide lost motion couplings coacting with forwardly projecting drive lugs on the tumbler wheels 35 and 36.

Figure 3:
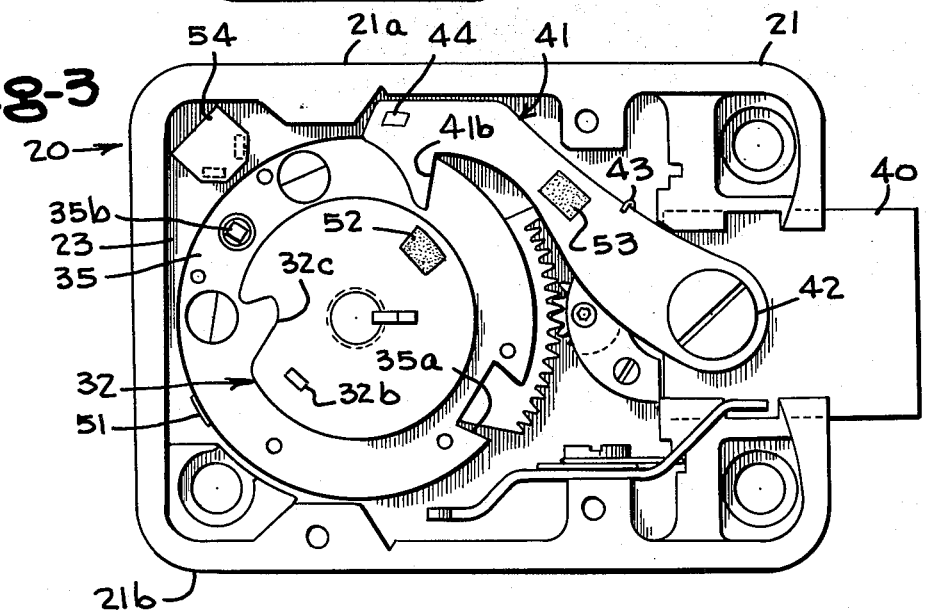
FIG. 3 is a rear elevation view of a combination lock embodying the present invention with the rear cover removed, showing the lock in locked condition.

The lock is also provided with the usual bolt 40 which is adapted to slide in a suitable guide way formed in one end wall of the lock case 21. The bolt 40 is operated by means of a fence lever 41 which is pivotally attached to the bolt by means of a screw 42. The fence lever 41 is normally resiliently urged to the elevated position illustrated in FIG. 3 by the lever spring 43 having, for example, one leg abutting the fence lever 41 and another leg abutting a stationary surface portion of the lock casing to resiliently urge the fence lever to rotate to the raised position. The fence lever 41 is provided with a laterally projecting bar 44, commonly referred to as a fence which projects along an axis parallel to the axis of the drive spindle 27 and overlies the peripheries of all of the tumbler wheels 35, 36 and 37. The fence 44 is adapted to be received in the peripheral gate, such as gate 35*a*, of the tumbler wheel when the tumbler gates are disposed in registry with each other at a chosen angular position upon operation of the dial and knob member 26 to the proper opening combination for the lock. When the dial and knob member 26 is rotated in a predetermined manner to bring the zero mark on the dial to a lock opening position, the consequent downward movement of the fence lever 41 causes the fence 44 to enter the peripheral gates of the three tumbler wheels as the fence lever nose descends into the gate of the drive cam, when disposed at the proper angular positions, and the free end of the fence lever 41 is cammed downwardly by the depending boss formation on the upper wall 21*a* of the lock case, and the fence lever 41 may be then shifted laterally to the left of the boss formation, as viewed in FIG. 3, to withdraw the bolt 40 from its projected or locking position.

The drive cam 32 is provided with a drive cam gate 32*c* adapted to receive the nose formation 41*b* of the fence lever 41. As will be observed from the illustration of the drive cam 32 in FIG. 3, the driving cam gate 32*c* has a pair of carefully shaped walls, one forming an inclined slightly convex wall portion for controlling the movement of the fence lever nose 41*b* into the driving cam gate and thereafter controlling the speed of approach of the fence 44 toward the peripheries of the tumbler wheels, and the other wall forming a shoulder for cooperating with a complimentary shoulder on the fence lever nose 41*b* to cause the fence lever to be shifted in a manner to retract the bolt 40 upon rotation of the drive cam in a clockwise direction as viewed in FIG. 3.

It will be appreciated that the stack of tumbler wheels, with their associated flies 38 and the spacer washers 39, may be retained on the tumbler post 22 in the usual manner, by providing a circular outwardly opening groove in a plane perpendicular to the axis of the tumbler post near the rearmost end of the tumbler post, in addition to the two diametrically opposite longitudinal grooves paralleling the tumbler post axis for receiving the spacer washer lugs, and removably locating a split ring or spiral spring ring 45 in the circular groove in the tumbler post bearing against the rearwardly facing edge of the rearmost tumbler or against another washer, if desired, bearing against the rearmost tumbler.

To enabling sensing of the condition of the combination lock by signals transmitted to a remote monitoring station, various movable components of the combination lock mechanism are provided with an optically distinctive zone or marking which will change the light reflected from a light source of a sensor unit associated with each optically distinctive zone to be monitored and an associated phototransistor which senses light reflectance from the monitored zone or station. Specifically, in the preferred embodiment herein described, three sensor units are provided, designed to sense the number 1 or rearmost wheel position, the fence lever position, and the drive cam position. To this end, the rearmost or number 1 tumbler wheel 35 is provided with a white reflector strip 51 on the perimeter of the tumbler wheel 35, the driving cam 32 is provided with a white strip or optically distinctive zone 52 on its rear face, and the fence lever 41 is provided with a white strip or optically distinctive zone or area 53 in an intermediate portion of the fence lever 41 between the pivot screw 42 and the fence lever nose 41*b*. In the illustrated embodiment, an optical sensor 54, for example a combined light source and phototransistor unit such as a Texas Instruments TIL 139 optical sensor is mounted at some convenient location in the lock case adjacent the path of travel of the white strip or marking 51 on the perimeter of the rearmost tumbler wheel 35, so that at some point in the travel of the tumbler wheel 35 when it is being rotated upon attempt to manipulate the lock, the tumbler wheel strip or marking 51 will pass into intercepting position with the light beam from the light source component of the optical sensor unit 54 and increase the light reflectance to the associated phototransistor of the sensor unit 54, producing a post output from that phototransistor of appropriate plurality. Additional similar optical sensor units 55 and 56, which are also TIL 139 sensors in the illustrated embodiment, are positioned adjacent the path of travel of the white or optically distinctive marking 52 on the drive cam 32 and the marking 53 on the fix lever 41 to similarly be activated by causing increased light reflectance to the associated phototransistor of the appropriate light sensor 55 or 56 to identify when the driving cam is being rotated or to identify when the fence lever is in either the bolt open or the bolt closed position, whichever is desired.

In each case, the remainder of the surface of the tumbler wheel 35 or the driving cam 32 or the fence lever 41 in the path of the light from the light source to the associated phototransistor of the associated optical sensor is of a different reflectance or color to provide trigger pulse or signal outputs to the sensing circuitry at the monitoring station, indicated generally by the reference character 58. In the illustrated example, the optical sensors 55 and 56 for sensing the drive cam position and the lever position are mounted on a signal printed circuit board carried by the rear cover plate or an enlarged rear case section 21*a* of the lock housing. Obviously, if desired, instead of using white optically distinctive markings 51, 52 and 53, dark or black markings may be used and the remainder of the tumbler wheel 35, driving cam 32 and fence lever 41 can be of significantly more highly reflective material, for example aluminum or other reflective metal surfaces.

Figure 6:
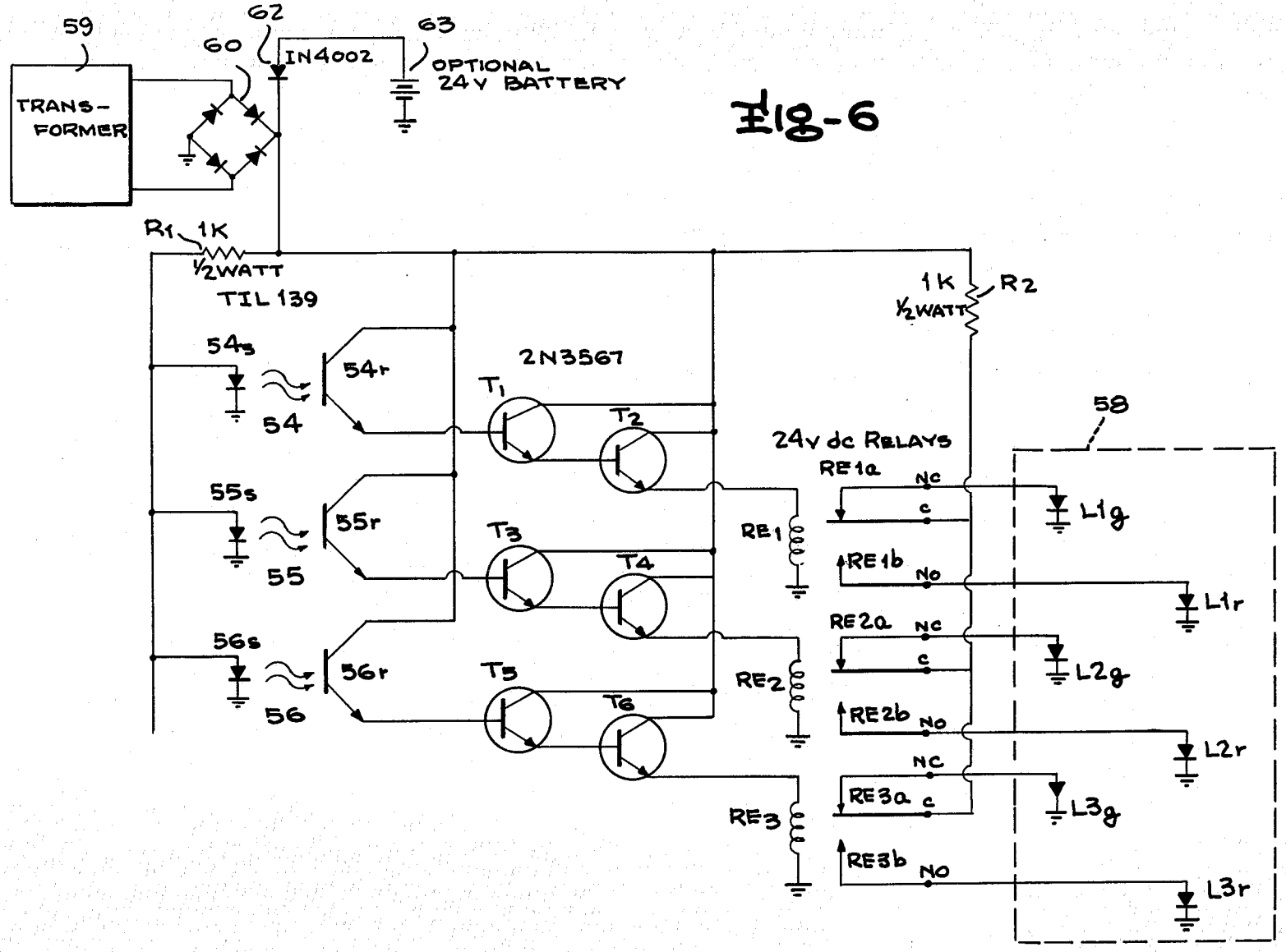
FIG. 6 is a schematic diagram of the electrical circuitry associated with the combination lock mechanism in the perferred embodiment.

FIG. 6 shows a schematic circuit diagram of suitable circuitry for use with the optical sensors 54, 55 and 56, either for a plug-in configuration powered from 110 volt nominal A/C supply or from a 24 volt battery. In the 110 volt supply arrangement, a 24 volt transformer 59 is provided to convert the 110 A/C input to its primary to 24 volt A/C output from its secondary windings, which are applied to a conventional rectifier bridge 60 to provide appropriate D/C voltage, for example about 24 volts on the supply conductor 61. Alternatively, the supply conductor 61 can be connected through a diode 62, for example an IN 4002 diode to a 24 volt battery 63. This main D/C supply from the conductor 61 is applied through a resistor R1, for example a IK resistor, to the supply terminal for the light source component 54*s*, 55*s* and 56*s* of the optical sensors 54, 55 and 56, and the main supply lead 61 is also connected to the collector terminal of the phototransistor component 54*r*, 55*r* and 56*r* of the three optical sensors 54,55, and 56. The emitters of the three phototransistors 54*r*, 55*r* and 56*r* are connected respectively to the base electrode of the first of a respective pair of transistors connected in a Darlington configuration to amplify the output from the respective phototransistor adequately to activate a respective associated 24 volt relay controlling differently colored Light Emitter Diodes (hereinafter referred to as LEDs) signalling the condition of the respective lock component. For example, the emitter of the phototransistor 54*r* is connected to the base of a transitor T1, whose emitter is connected to the base of a transistor T2, the emitter of the later being connected to the coil of a relay RE1 as illustrated. The normally closed contact RE1*a* is connected through a green LED indicated by the reference character L1g to ground and the normally open contact RE1*b* of that relay is connected to ground through a red LED L1r. Similarly, the emitter of the phototransistor 55*r* is connected to the base of transistor T3 whose emitter is connected to the base of transistor T4, the emitter of the latter being connected to the coil of the relay RE2 whose contacts RE2*a* and RE2*b* are connected respectively to ground through green LED L2*g* and red LED L2*r*. Transistors T5 and T6 are connected in like manner to each other and to the emitter of phototransistor 56*r* and to the relay coil of relay RE3 whose contacts RE3*a* and RE3*b* are connected to ground through green LED L3*g* and red LED L3*r* respectively. The movable contact of the relays RE1, RE2 and RE3 in each instance is powered from the main supply lead 61 through a resistor R2, which may also be a 1K resistor.

It would be appreciated that in most installations, the optical sensors will be incorporated in the normal housing or forward case portion 21 of the combination lock, and the electronics, made up of the transistors T1–T6 may be provided in an enlarged rear case portion 21*a* substituted for the normal rear cover plate of a conventional combination lock housing, and the relays RE1--RE3 and associated LEDs controlled thereby, together with the battery, if a battery powered installation is desired, may be provided in a separate console at the remote monitoring station 58, interconnected with the electronics in the lock housing portion 21*a* by a multiple conductor cable with the console unit being supplied with 24 volt D/C power by the battery or 24 volt A/C power from the transformer 59 and associated bridge rectifier 60.

We claim:

1. In a combination lock having a lock case provided with a tumbler post, a rotatable combination lock dial positioned for manual manipulation to dial the lock combination and having spindle means driven thereby extending through the tumbler post, a lock mechanism in said case having components including a plurality of rotatable members to be rotatably positioned responsive to rotation of said dial comprising a tumbler wheel stack formed of a plurality of peripherally gated tumbler wheels loosely journaled on said tumbler post for rotation about its axis and a peripherally gated rotatable driving cam driven from the dial, coupling means intercoupling the driving cam and tumbler wheels for adjusting the angular positions of the tumbler wheels responsive to dial rotation, and a fence lever pivotally connected to a bolt for shifting the bolt between locked and unlocked positions and having a fence insertable into the peripheral gates of the tumbler wheels when they are properly aligned following dialing of the proper lock combination; the improvement comprising electro-optical light sensing and electrical signalling means for producing sensible indications at a remote monitoring station signifying movement of components of the combination lock mechanism comprising an optically distinctive marking on a component of the lock mechanism which moves during manipulation of the lock including at least one of said rotatable members, said marking having optically distinctive reflectivity properties from remaining parts of such component which occupy any of the path of movement traversed by the optically distinctive marking during movement of its associated component, optical sensor means including a light source for directing light onto the path traversed by said optically distinctive marking during movement thereof responsive to attempted opening manipulation of the lock and photosensor means positioned to receive light from said light source reflected from said optically distinctive marking at predetermined positions thereof for generating movement detection electrical signal signifying movement of said optically distinctive marking, electrical signal amplifying means for receiving said signal and producing an amplified output, and electrical circuit means including alarm signal producing means activated by said amplified signals to produce a sensible alarm signal at a remote monitoring station signifying movement of said optically distinctive marking.

2. A combination lock as defined in claim 1, wherein said alarm means includes light generating elements at the monitoring station producing sensitive colored light signals signifying movement of the optically distinctive area during the monitoring time period.

3. A combination lock as defined in claim 1, wherein an optically distinctive marking is provided on a preselected portion of said fence lever in addition to the optically distinctive marking on at least one of said rotatable members, and additional light source and light sensor means positioned relative to the optically distinctive marking of said fence lever to cause reflected light from the associated light source to be reflected to and detected by the associated light sensor for producing an electrical detection signal upon movement of the fence lever from its normal position during the monitoring period, and signal amplifying means and alarm signal generating means associated therewith for producing a sensible alarm signal at the monitoring station signifying movement of the optically distinctive marking of the fence lever.

4. A combination lock as defined in claim 1, wherein the tumbler wheels stack include a rearmost tumbler wheel nearest said driving cam and both said rearmost tumbler wheel and said driving cam have a said optically distinctive markings thereon, said light source and light sensing means including a light source and light sensing means respectively individually associated with the optically distinctive markings on each of said rearmost tumbler wheel and said driving cam, and the remainder of said rearmost tumbler wheel and said driving cam in the path thereof which intercepts the light beam path from the associated light source to the associated photosensor means during rotary movement of the rearmost tumbler wheel and driving cam during manipulation of the combination lock dial upon attempted opening of the lock being of different reflected properties from the optically distinctive markings producing a sensible difference in reflectivity to the associated photosensor means.

5. A combination lock as defined in claim 3, wherein the tumbler wheel stack include a rearmost tumbler wheel nearest said driving cam and both said rearmost tumbler wheel and said driving cam have a said optically distinctive markings thereon, said light source and light sensing means including a light source and light sensing means respectively individually associated with the optically distinctive markings on each of said rearmost tumbler wheel and said driving cam, and the remainder of said rearmost tumbler wheel and said driving cam in the path thereof which intercepts the light beam path from the associated light source to the associated photosensor means during rotary movement of the rearmost tumbler wheel and driving cam during manipulation of the combination lock dial upon attempted opening of the lock being of different reflected properties from the optically distinctive markings producing a sensible difference in reflectivity to the associated photosensor means.

6. A combination lock as defined in claim 1, wherein said amplifying and alarm signal generating means includes an electrical relay at said monitoring station having stationary contacts respectively connected to first and second light emitting elements producing light of respective different colors and the movable contact thereof is normally in electrical circuit-making contact with the stationary contact connected to the light generating means producing one of said colors, and said amplifying means provides current adequate to energize the associated relay to shift its movable contact to the other of said stationary contacts associated therewith responsive to the movement detection electrical signal from the associated photosensor means.

* * * * *